United States Patent [19]

Kessoku

[11] Patent Number: 4,713,673

[45] Date of Patent: Dec. 15, 1987

[54] IMAGE FORMING APPARATUS IN WHICH MULTIPLE DEVELOPING UNITS ARE SUPPORTED AND MOVED RELATIVE TO AN IMAGE CARRIER

[75] Inventor: Hirobumi Kessoku, Yokohama, Japan

[73] Assignee: Kabushiki Kaisha Toshiba, Kawasaki, Japan

[21] Appl. No.: 847,457

[22] Filed: Apr. 3, 1986

[30] Foreign Application Priority Data

Apr. 8, 1985 [JP] Japan ..... 60-73848
Apr. 10, 1985 [JP] Japan ..... 60-75541

[51] Int. Cl.[4] ..... G03G 15/01
[52] U.S. Cl. ..... 355/4; 355/300
[58] Field of Search ..... 355/4, 300, 140; 118/645

[56] References Cited

U.S. PATENT DOCUMENTS 3,906,897 9/1975 Davidson ..... 118/645
3,987,756 10/1976 Katayama et al. ..... 355/4

FOREIGN PATENT DOCUMENTS 57-111555 7/1982 Japan ..... 355/4
60-123869 7/1985 Japan ..... 355/4

*Primary Examiner*—A. T. Grimley
*Assistant Examiner*—J. Pendegrass
*Attorney, Agent, or Firm*—Oblon, Fisher, Spivak, McClelland, & Maier

[57] ABSTRACT

An image forming apparatus comprises four developing units for developing an electrostatic latent image formed on a photosensitive drum, and a revolving unit for revolving the developing units in parallel relation and selecting one of the developing units for use by stopping to revolve the developing units at a predetermined position. The four developing units are stored individually with developing agents of different types. The revolving unit is supported by a rockable suspension member at a distance from the center of rocking of the member, and can swing toward and away from the drum. The revolving unit is moved toward and away from the drum by a shifting mechanism. A locating member is attached to each developing unit, while a locating pin is provided on a housing of the apparatus. When the revolving unit is brought close to the drum by the shifting mechanism, the relative positions of the drum and the developing unit selected by the revolving unit are determined.

7 Claims, 36 Drawing Figures

IMAGE FORMING APPARATUS IN WHICH MULTIPLE DEVELOPING UNITS ARE SUPPORTED AND MOVED RELATIVE TO AN IMAGE CARRIER

FIELD OF THE INVENTION

The present invention relates to an image forming apparatus such as a copying machine, and more specifically to an image forming apparatus capable of forming multicolor images.

BACKGROUND OF THE INVENTION

Image forming apparatuses, such as copying machines, have conventionally been developed which can produce copy images of different colors by replacing developing units. However, the replacement of these units, in these apparatuses, is very troublesome.

Thereupon, a copying machine as shown in FIG. 1 has recently been proposed. In this machine, developing units 1, e.g., four in number, are first revolved around a common axis in parallel relation so that one of units 1 is selected for use. Thereafter, an electrostatic latent image on photosensitive drum 2 is developed by means of the selected developing unit.

Generally, in the copying machine, a space for developing units 1 is secured between optical system 4 for optically scanning the original on original table 3 and paper supply system 5 for supplying copying sheets P. The space is fanned out from photosensitive drum 2. Therefore, if units 1 are revolved around center A in a position closer to drum 2, they interfere with optical system 4 and paper supply system 5 at regions 6 and 7, respectively.

Conventionally, in replacing developing units 1, they are first slid horizontally to a position remoter from drum 2, and then revolved around center B.

In this case, however, the replacement requires a mechanism for horizontally sliding the relatively heavy developing units. Thus, the apparatus must be provided additionally with a strongly-built, complicated mechanism, such as slide rails, parallel motion mechanism, etc.

OBJECT OF THE INVENTION

The object of the present invention is to provide an image forming apparatus in which developing units can be supported and moved relative to an image carrier by means of simple mechanisms.

BRIEF DESCRIPTION OF THE DRAWINGS

FIGS. 2 to 15 show a copying machine as an image forming apparatus according to an embodiment of the present invention, in which FIGS. 2 and 3 are schematic views showing the internal structure of the machine, FIG. 4, a schematic view, partially in section, showing a revolving unit for a developing device, FIG. 5 is a schematic view showing the revolving unit and a shifting mechanism for the developing device, FIG. 6 is a front view of a rotating frame, FIG. 7 is a perspective view of a coupling mechanism, FIG. 8 is a sectional view of a male coupling member, FIG. 9 is a schematic view showing an arrangement of timing belts, FIG. 10 is a schematic view for illustrating the shifting mechanism and locating means, FIG. 11 is a sectional view of a developing unit, FIG. 12 is a partially exploded perspective view of the developing unit, and FIGS. 13, 14 and 15 are schematic views showing a drive system for the developing units;

FIGS. 16 and 17 show a modification of a toner hopper of the developing unit, in which FIG. 16 is a sectional view showing the way the hopper is loaded with a toner cartridge, and FIG. 17 is a sectional view showing a state in which the cartridge is held in the hopper;

FIGS. 18 and 19 show a modification of the locating means, in which FIG. 18 is an exploded perspective view, and FIG. 19 is a plan view;

FIGS. 20 and 21 show a modification of connector means used in the locating means of FIGS. 18 and 19, in which FIG. 20 is an exploded perspective view, and FIG. 21 is a plan view;

FIGS. 22 to 25 show a modification of the developing unit, in which FIG. 22 is a sectional view showing the internal structure of the unit, FIG. 23 is a sectional view showing the toner hopper of the unit in a lifted position, FIG. 24 is a diagram showing the developing unit drive system and hopper lifting mechanism, and FIG. 25 is a perspective view showing the principal part of the lifting mechanism;

FIGS. 26 to 28 show a modification of the hopper lifting mechanism, in which FIG. 26 is an illustrative diagram, FIG. 27 is a perspective view showing a part of the mechanism, and FIG. 28 is a sectional view showing the principal part;

FIGS. 29 to 34 show a modification of the developing device, in which FIG. 29 is a front view showing a part of the device, FIG. 30 is rear view schematically showing the part, FIG. 31 is a sectional view showing the internal structure of a developing unit, FIG. 32 shows a drive system for the unit, FIG. 33 is a perspective view of the part, and FIG. 34 is a sectional view of the part; and FIGS. 35 and 36 show a modification of the revolving unit, in which FIG. 35 is a side view of the unit, and FIG. 36 is a schematic view showing an arrangement of timing belts.

DETAILED DESCRIPTION OF THE PREFERRED EMBODIMENT

An embodiment of the present invention will now be described in detail with reference to the accompanying drawings of FIGS. 2 to 15.

Figure 1:
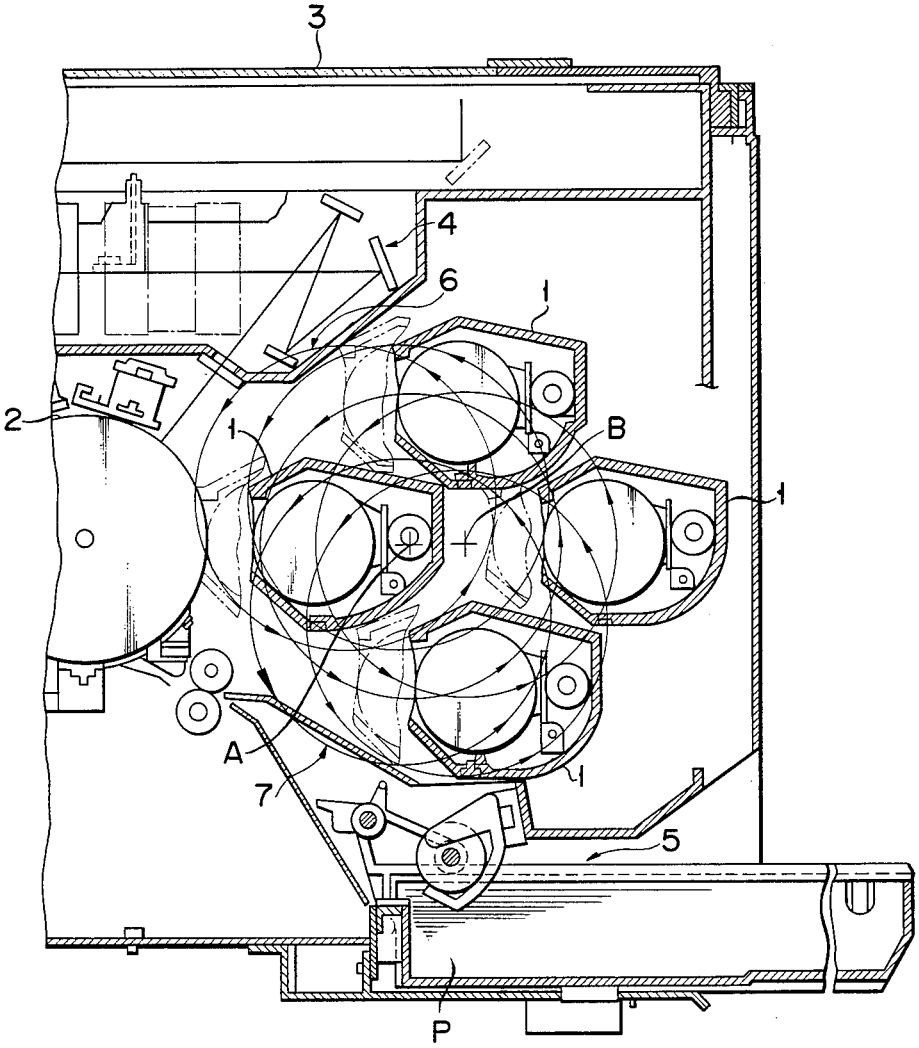
FIG. 1 (PRIOR ART)
FIG. 1 is a schematic view showing the internal structure of a prior art copying machine.
Figure 2:
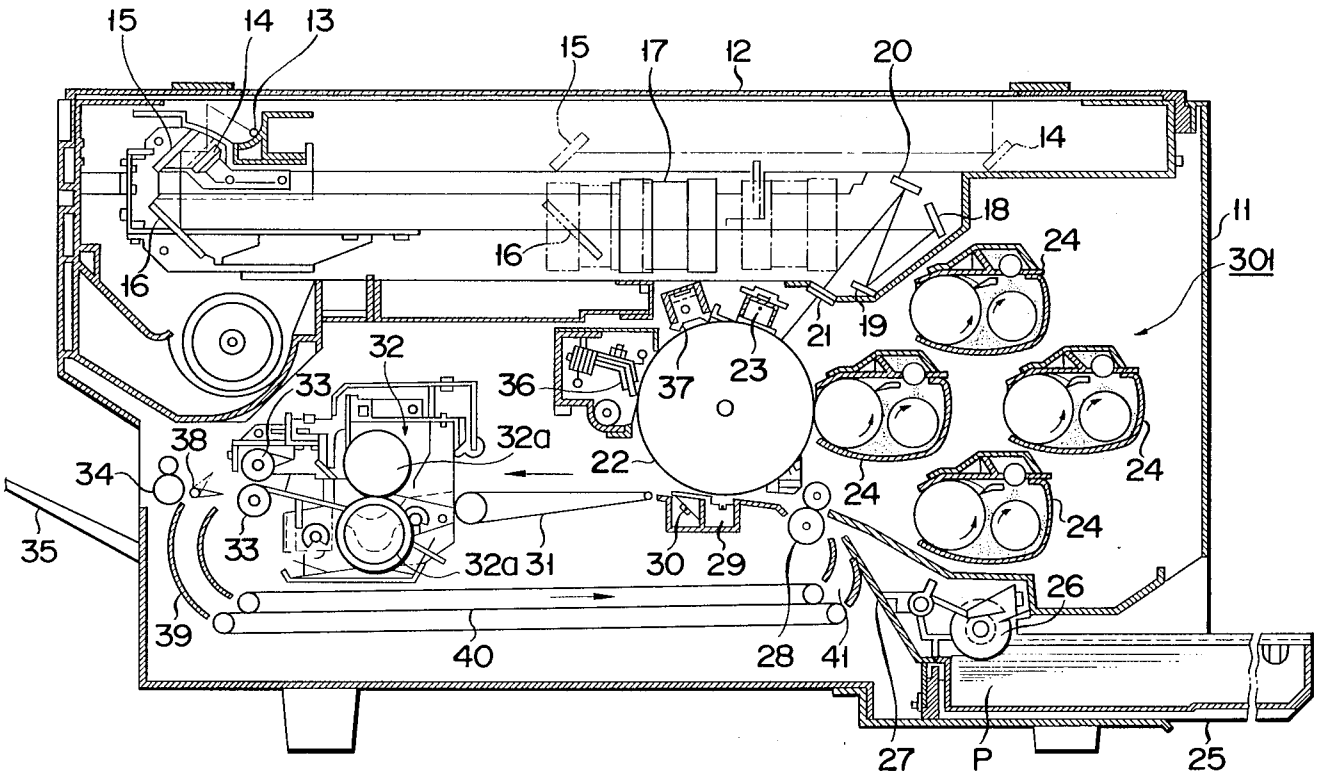

FIG. 2 shows a copying apparatus capable of multiple copying as an example of an image forming apparatus according to the present invention. In FIG. 2, numeral 11 designates a housing of the copying machine. Housing 11 carries thereon original table 12 on which the original is to be placed. The original placed on table 12 is optically scanned by an optical system which, including exposure lamp 13 and mirrors 14, 15 and 16, reciprocates along the underside of table 12. The original is exposed as the system advances. Mirrors 15 and 16 move at half the speed of mirror 14 so that the length of an optical path, extending between the original and photosensitive drum 22 as an image carrier (to be described later), is fixed. A reflected light beam from the original, resulting from the scanning by the optical system or irradiation by lamp 13, is first reflected by mirrors 14, 15 and 16 in succession. Then, after passing through lens block 17 for copy ratio setting, it is further reflected successively by mirrors 18, 19 and 20. Thereafter, the beam strikes drum 22 through slit 21. As a result, an image of the original is projected on the surface of drum 22. Drum 22 rotates in a predetermined direction, such that its surface is first charged by main charger 23 and then subjected to a slit-exposure to the original image. Thus, an electrostatic latent image is formed on the drum surface. The latent image is visualized when a developing agent or toner is applied to it by developing device 301 which will be detailed later.

Paper sheets P are delivered one by one from sheet cassette 25 by paper-supply roller 26. Each delivered sheet P is guided along sheet guide path 27 to reach a pair of aligning rollers 28. Then, it is aligned by rollers 28 and fed into an image transfer region. Sheet cassette 25 is removably attached to the right-hand bottom end portion of housing 11. Sheet P in the transfer region is brought into intimate contact with the surface of photosensitive drum 22 at a position corresponding to transfer charger 29. In this state, the toner image on drum 22 is transferred to sheet P by the agency of charger 29. After the image transfer, sheet P is electrostatically separated from drum 22 by separation charger 30, and transported by conveyor belt 31 to a pair of fixing rollers 32*a* of fixing unit 32 which faces the delivery-side end of belt 31. As the sheet passes through unit 32, the transferred toner image is fixed on it. Sheet P is then delivered to a pair of exit rollers 34 by a pair of feed rollers 33, and discharged into tray 35 outside housing 11 by rollers 34. After the transfer, the residual toner on drum 22 is removed by cleaner 36, followed by removal of a residual image by discharge lamp 37. Thus, it is restored to its initial state.

Disposed between feed rollers 33 and exit rollers 34 is guide selector 38 for switching the course of sheet P. In a normal copying operation, sheet P from rollers 33 is guided to rollers 34 by selector 38. In a multiple copying operation, selector 38 guides sheet P onto sheet guide path 39 along which the sheet is transported to the lower part of the inside of housing 11. When introduced into path 39 in this manner, sheet P is led onto transport path 40, whereby it is brought almost to the position of sheet cassette 25. Then, it is delivered to aligning rollers 28 via sheet guide path 41. Thus, in the multiple copying operation, sheet P is circulated as indicated by arrows in FIG. 2.

Figure 3:
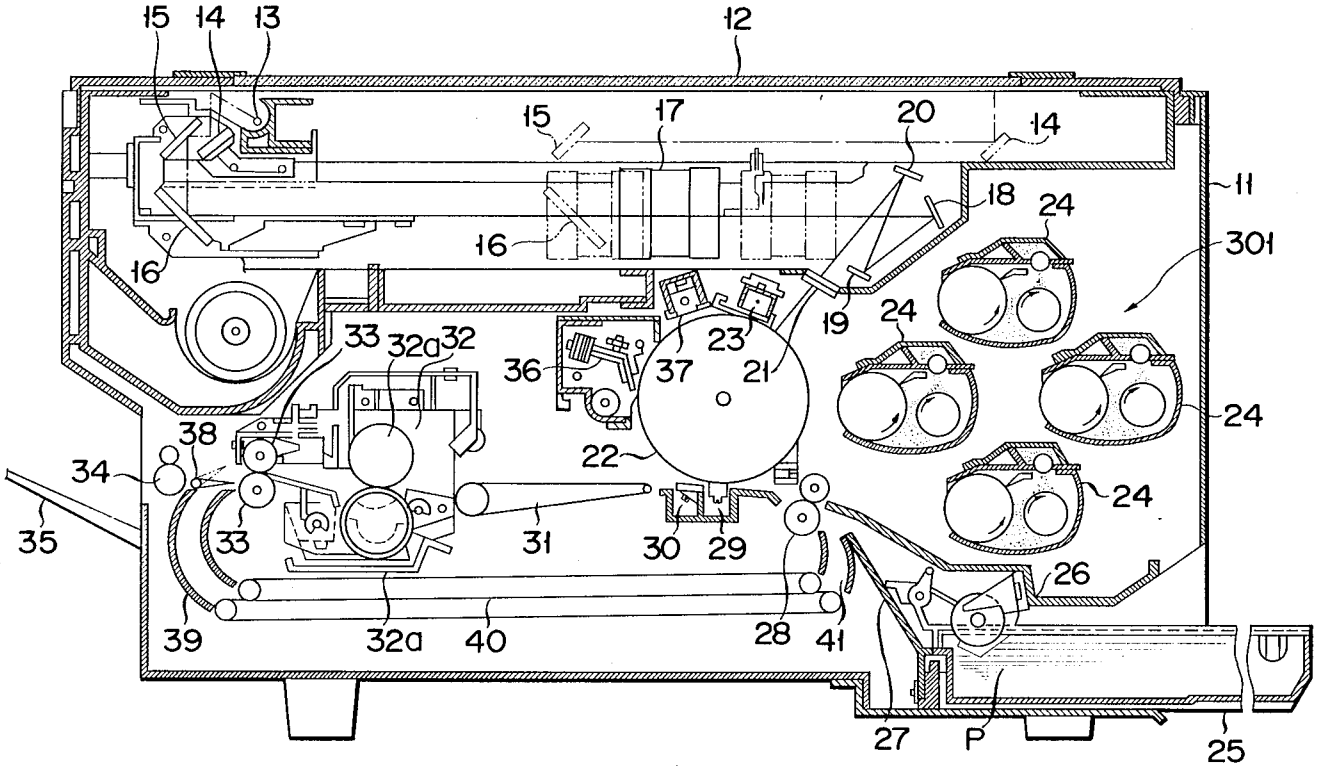

Developing device 301 includes, for example, four developing units 24. After they are revolved parallel to one another or in a horizontal posture by revolving unit 51 (shown in FIG. 4), the developing units are stopped at a predetermined position. Thus, one of the four units can be selected as required. Device 301 can be moved in the horizontal direction of FIG. 2 (in which the device approaches or leaves drum 22) by shifting mechanism 78 (shown in FIG. 5) which will be detailed later. During the copying operation, selected developing unit 24 is opposed close to drum 22, as shown in FIG. 2. In selecting unit 24, developing device 301 is moved to a predetermined distance from drum 22, as shown in FIG. 3. After the selection, device 301 is moved again to the side of drum 22 so that the selected developing unit faces the drum, as shown in FIG. 2.

Developing device 301 will now be described in detail.

Figure 4:
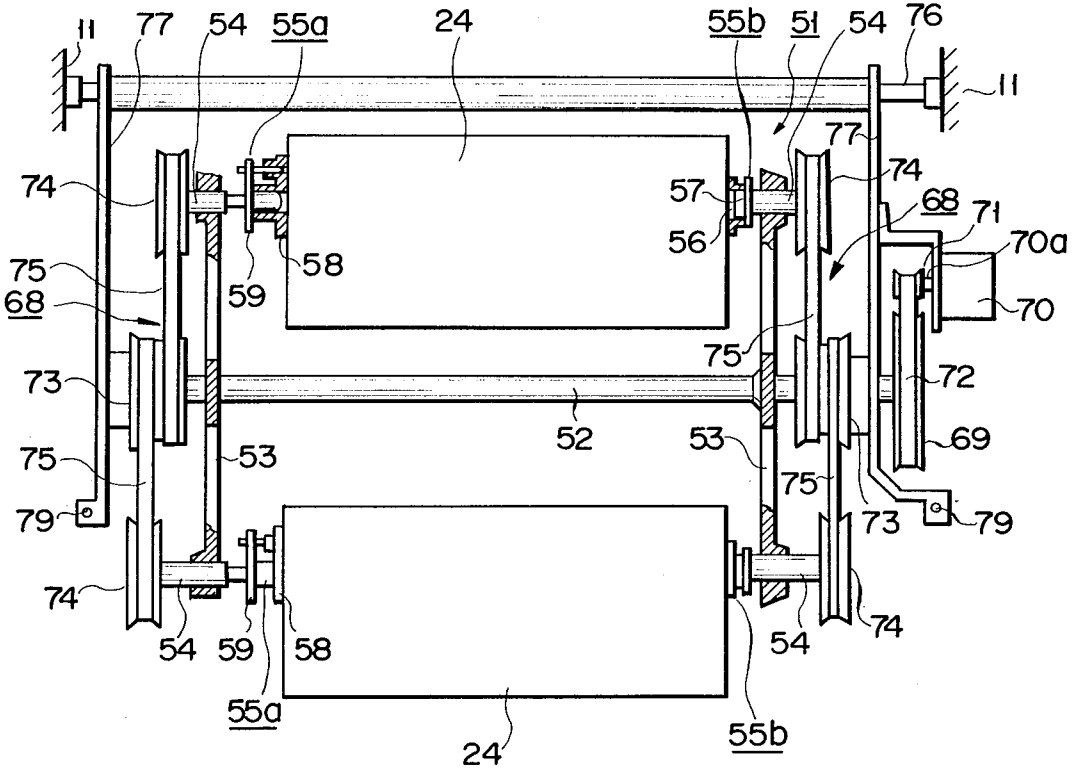
Figure 5:
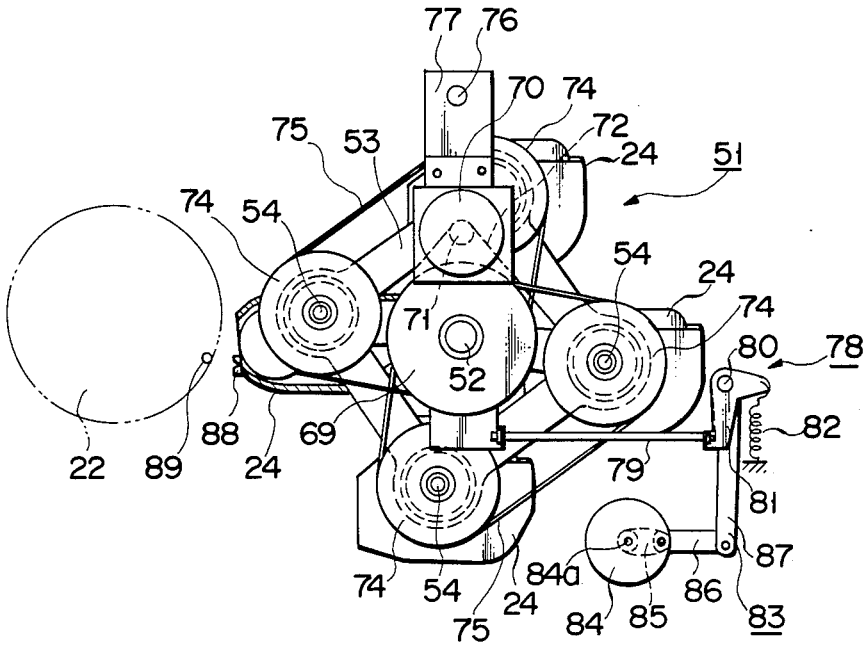
Figure 6:
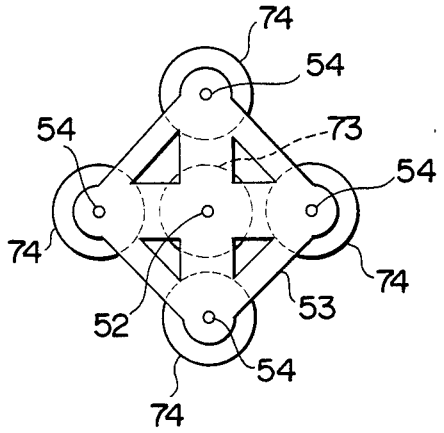
Figure 7:
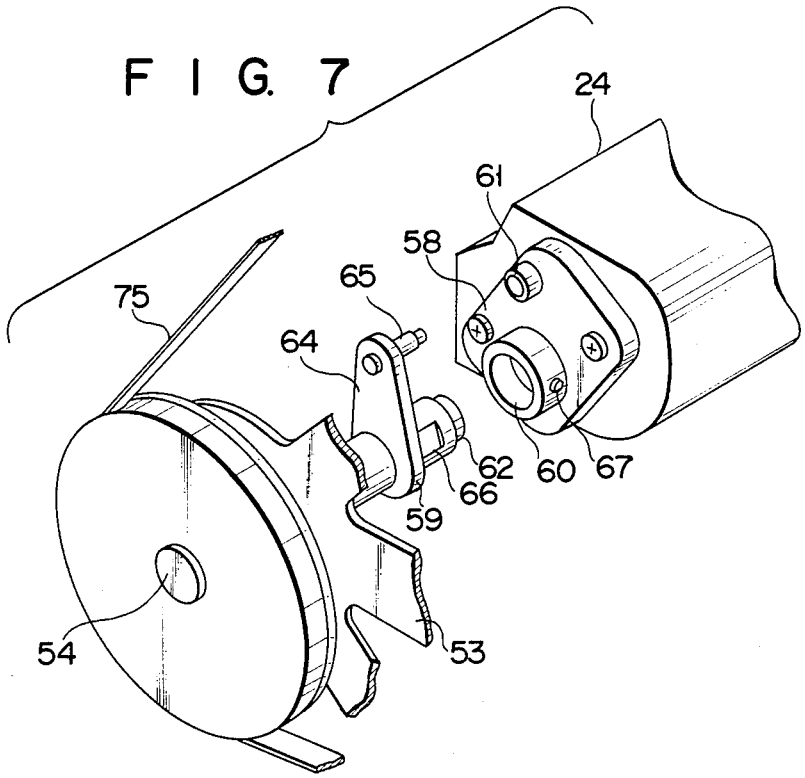
Figure 8:
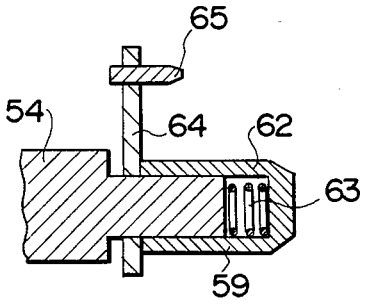

In FIGS. 4 and 5, numeral 51 denotes the revolving unit. Unit 51 includes a pair of rotating frames 53 (shown in FIG. 6) which are arranged beside either end of shaft 52. Four developing unit supporting shafts 54 are rotatably mounted on each frame 53 by means of bearings (not shown) or the like. Shafts 54 on one rotating frame face their corresponding ones on the other. The four pairs of shafts constitute part of a pair of retaining mechanisms 68 which will be described in detail later. The four developing units are arranged between facing shafts 54 in four pairs with the aid of their corresponding pairs of coupling mechanisms 55*a* and 55*b*. Each mechanism 55*a* or 55*b* serves to connect its corresponding end of one of developing units 24 to one of supporting shafts 54 on each corresponding side. Coupling mechanism 55*b* includes engaging recess member 56 mounted on one side of each developing unit 24 and engaging projection member 57 attached to each shaft 54 and adapted to engage recess member 56. When in engagement with each other, members 56 and 57 rotate as one. As shown in in detail FIG. 7, coupling mechanism 55*a* includes female coupling member 58 mounted on the other side of each developing unit 24 and male coupling member 59 attached to each shaft 54. Member 58 has large- and small-diameter recess portions 60 and 61. As shown in detail in FIGS. 7 and 8, moreover, member 59 has coupling body 62 fitted on the tip end of developing unit supporting shaft 54 for axial slide. Body 62 is urged toward developing unit 24 by spring 63, and can rotate together with shaft 54. Flange member 64 is fixed to the rear end face of body 62, and pin 65 is fixed to member 64. Body 62 engages large-diameter recess portion 60 to support developing unit 24, while pin 65 engages small-diameter recess portion 61 to transmit the moment of rotation. Notch 66 is formed in the peripheral surface of coupling body 62, while setscrew 67; is attached to part of the peripheral wall of large-diameter recess portion 60. Coupling members 58 and 59 are secured to each other by screwing setscrew 67 into notch 66. In setting developing unit 24, recess member 56 and projection member 57 of coupling mechanism 55*b* are engaged first. In this state, male coupling member 59 of mechanism 55*a* is temporarily retracted against the urging force of spring 63 so that coupling body 62 and pin 65 can engage recess portions 60 and 61, respectively.

Figure 9:
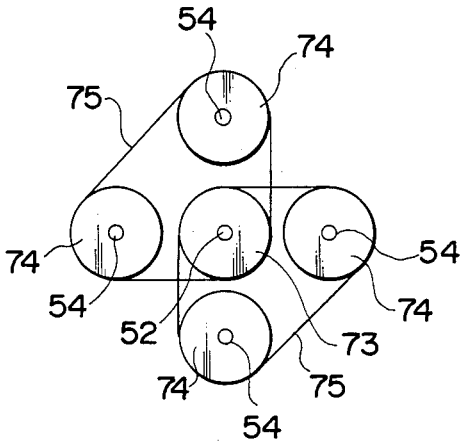

Retaining mechanisms 68 (see FIG. 5), which are disposed individually outside rotating frames 53, serve to hold developing unit supporting shafts 54 so that four developing units 24 are oriented regularly or horizontally. Pulley 69 is fixed to one end of shaft 52. Timing belt 72 is passed around pulley 69 and pulley 71 which is fixed to shaft 70*a* of motor 70. As the driving force of motor 70, after deceleration, is transmitted to shaft 52, frame 53 rotates. Fixed pulleys 73 (see FIG. 4) are fitted individually on the two ends of shaft 52. While they are rotatable relative to shaft 52, pulleys 73 are fixed to housing 11. Thus, even if frames 53 rotate, these pulleys cannot rotate. Planet pulley (revolving pulley) 74 is fixed on each supporting shaft 54. As shown in FIG. 9, timing belt 75 is passed around each fixed pulley 73 and each two of its corresponding planet pulleys 74. Pulleys 73 and 74 have the same outside diameter. When rotating frames 53 rotates on their own axes, planet pulleys 74 revolve around fixed pulley 73 without rotating on their own axes. Thus, developing units 24 move parallel to one another, maintaining the horizontal lie. The developing units must behave in this manner because they each contain a powdery developing agent (toner).

For example, first to fourth developing units 24 may contain black, red, green and blue toners, respectively.

As shown in FIG. 4 revolving unit 51 is suspended from support shaft 76 which is fixed to housing 11. A pair of suspension members 77 are rockably supported, at one end side thereof, on shaft 76. Fixed pulleys 73 are fixed individually to the other end side of members 77. Thus, unit 51 hangs so as to be swingable around shaft 76. In this state, the center of gravity of unit 51 is located on a straight line passing through shafts 76 and 52. In this state, moreover, all developing units 24 are kept apart from photosensitive drum 22, allowing revolving unit 51 to revolve.

Figure 10:
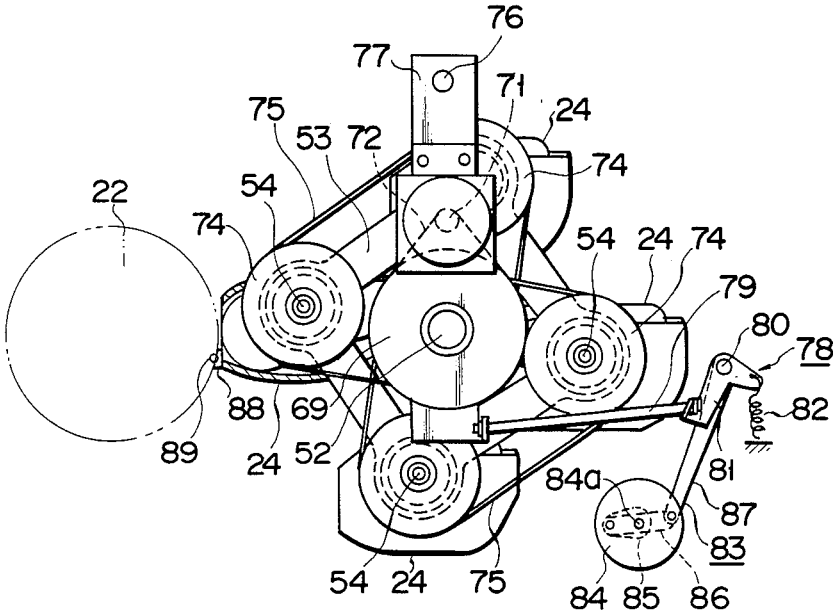

In FIG. 5, numeral 78 designates the shifting mechanism. Mechanism 78 serves to move revolving unit 51 hanging on suspension members 77 toward or away from photosensitive drum 22. One end of rod 79 is coupled to the lower end portion of each member 77, while lever 81, fixed to rocking shaft 80, is connected to the other end of rod 79. Lever 81 is urged by spring (resilient member) 82 to rock and press the lower end side of suspension member 77 through the medium of rod 79, thereby revolving unit 51 toward drum 22. Lever 81 is connected with crank mechanism 83 for parrying the urging action of spring 82. Mechanism 83 includes motor 84, first arm 85, link 86, and second arm 87. Arm 85 rotates around its one end portion, driven by motor 84. One end portion of link 86 is coupled to the other end portion of arm 85. One end portion of arm 87 is coupled to the other end portion of link 86. Arm 87 is fixed, at the other end portion thereof, to shaft 80 so as to rock with lever 81. If motor 84 rotates to cause first arm 85 to turn to the right, as shown in FIG. 5, lever 81 is rocked against the urging force of spring 82, so that revolving unit 51 is separated from photosensitive drum 22. In this state, unit 51 is rotated, and developing units 24 are revolved. In this position, moreover, shaft 84*a* of motor 84, first arm 85, and link 86 are arranged in a straight line with one another and at right angles to second arm 87. Even when motor 84 is deenergized and allowed to race, therefore, revolving unit 51, which is urged toward drum 22 by spring 82, is prevented from moving by arm 85 and link 86. Thus, unit 51 is kept from engaging drum 22 while it is rotating, that is, during the revolution of developing units 24. If motor 84 further rotates to cause arm 85 to turn to the left, as shown in FIG. 10, lever 81 is rocked by the urging force of spring 82, so that selected developing unit 24 is moved toward the developing region of drum 22. At this time, locating member 88 attached to unit 24 dashes against locating pin 89 on housing 11, thereby maintaining a fixed gap between unit 24 and drum 22. Spring 82 has an urging force greater than the force of suspension members 77 to leave drum 22 by the gravity of revolving unit 51. Thus, even if motor 84 is deenergized and allowed to race, selected developing unit 24 cannot separate from drum 22.

Figure 11:
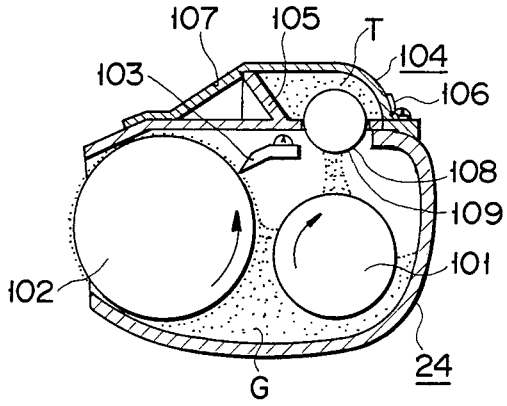
Figure 12:
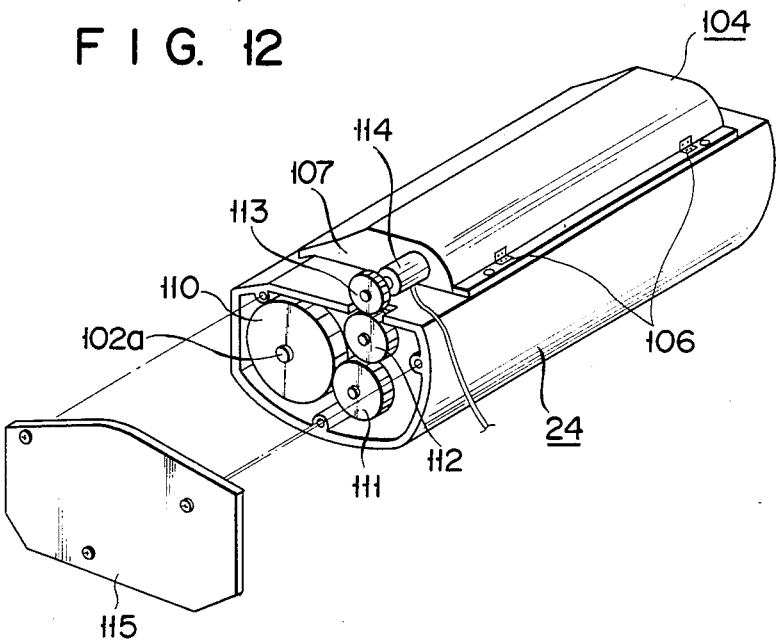
Figure 13:
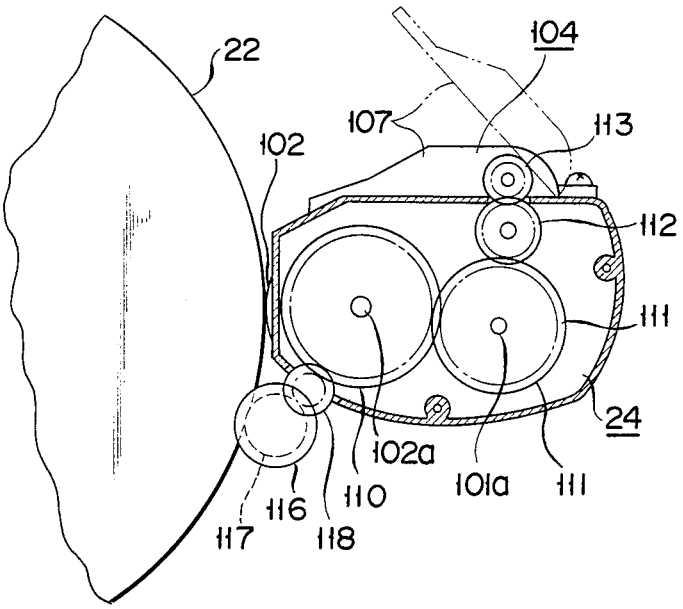
Figure 14:
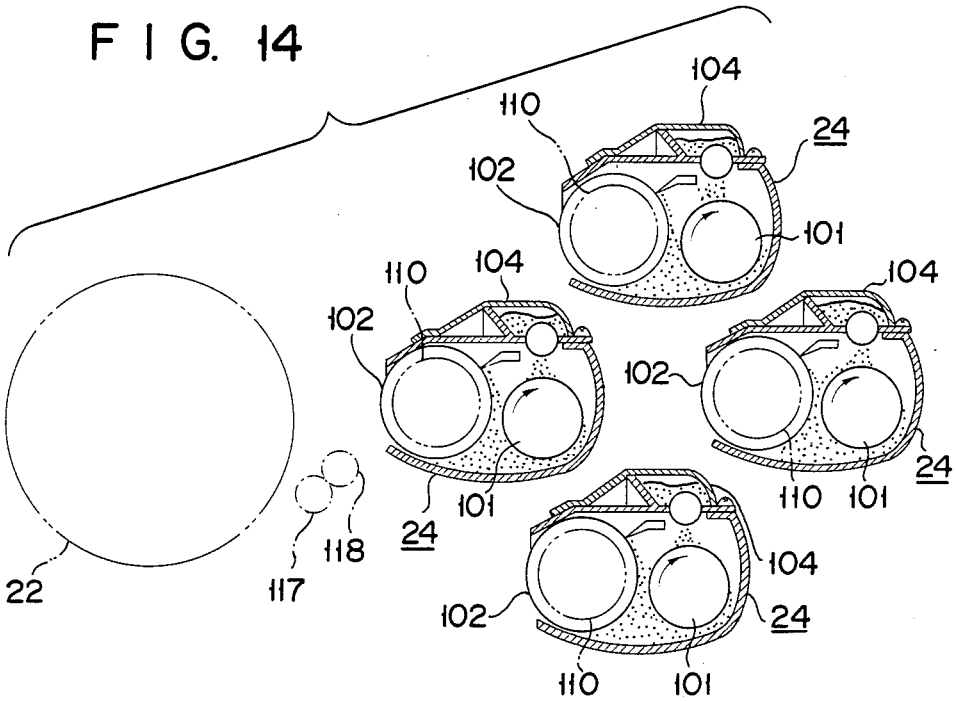
Figure 15:
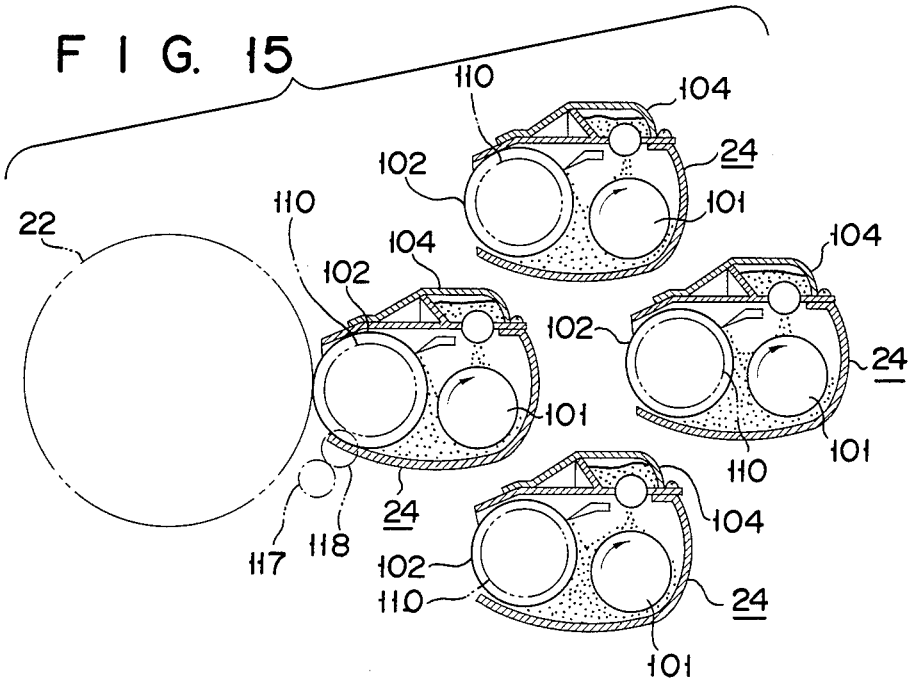

As shown in FIG. 11, each developing unit 24 contains therein two-component developing agent G formed of, e.g., a carrier and toner T, stirrer 101 for stirring the agent G, developing roller 102 for conveying the stirred developing agent to feed toner T therein onto photosensitive drum 22, and doctor blade 103 for regulating the thickness of a layer of developing agent G being advanced toward drum 22 by roller 102. Unit 24 is overlain by integral toner hopper 104 for replenishing the unit with toner T in agent G. Thus, hopper 104 is located in a space such that developing units 24 do not interfere with one another in movement. The hopper includes toner receptacle 105 for receiving toner T, hopper cover 107 supported by hinges 106 and adapted to expose receptacle 105 when removed, toner resupply aperture 108 through which toner T is supplied from receptacle 105 to unit 24, and resupply roller 109 disposed in aperture 108. As shown in FIGS. 12 and 13, developing roller gear 110 is mounted on shaft 102*a* of developing roller 102, and stirrer gear 111 mounted on shaft 101*a* of stirrer 101 is in mesh with gear 110. Resupply roller gear 113 is in mesh with idle gear 112 which is in mesh with gear 111. Gear 113 is connected to the shaft of resupply roller 109 by means of electromagnetic spring clutch 114. Gears 110, 111 and 112 are hidden by drive section cover 115. Provided on the side of housing 11, on the other hand, are driving gear 117 mounted on the shaft of drive motor 116 and idle gear 118 in mesh with gear 117. When selected developing unit 24 of developing device 301 is separated from photosensitive drum 22, as shown in FIG. 14, idle gear 118 and developing roller gear 110 are disengaged. If selected unit 24 approaches drum 22, as shown in FIG. 15, gears 118 and 110 engage each other, so that the driving force is transmitted through gear 110, stirrer gear 111, idle gear 112, and resupply roller gear 113 in the order named. The transmission of the driving force is continued and discontinued as clutch 114, which is interposed between gear 113 and resupply roller 109, is energized and deenergized, respectively. Thus, toner T can be supplied intermittently.

The operation of an apparatus constructed in this manner will now be described. In a multiple copy mode, the operator first sets a first original on original table 12 and depresses a multiple copy mode key (not shown). Then, if he selects developing unit 24 stored with the red toner by depressing a selector key (not shown) for red copy, for example, revolving unit 51 moves away from photosensitive drum 22 to establish the state shown in FIG. 3. When unit 51 ceases from moving, rotating frames 53 are rotated by motor 70 for selection. As a result, developing units 24 start to revolve in parallel relation and stop when that developing unit containing the red toner faces drum 22. Thereafter, revolving unit 51 is moved toward drum 22, so that selected unit 24 is opposed close to drum 22. Thus, the selection of developing unit 24 corresponding to the specified color, i.e., red, for red copy is completed. Subsequently, a red-copying operation is started using the selected developing unit. First, the original is scanned for an exposure, so that an electrostatic latent image is formed on the surface of drum 22. Then, the latent image is fed with toner T by selected unit 24 to be visualized as a toner image. The toner image is transferred to paper sheet P which is supplied from sheet cassette 25. After the transfer, sheet P is transported by conveyor belt 31 to fixing rollers 32*a* to be fixed thereby, and then delivered to feed rollers 33. After the fixation, it is delivered to selector 38 by rollers 33 which is then set in the position indicated by full line in FIG. 2. Thereupon, the sheet is turned and carried into transport path 40 by selector 38 and sheet guide path 39. Then, it is brought to a position just short of aligning rollers 28, where it is temporarily stopped to be ready for a copying cycle for the next color.

The operator sets a second original on original table 12. Hereupon, he cancels the multiple copy mode by depressing a mode key in order to abandon the multiple copying operation. If he then selects developing unit 24 stored with the black toner by depressing a selector key for black copy, for example, the apparatus gets ready for a black-copying operation. To continue the multiple copying operation, the operator must only maintain the multiple copy mode. When the multiple copy mode is canceled, the same copying operation as aforesaid is started for a black copy. In this case, the black copy is superposed on the previous red copy. After the superpositive copying, sheet P is delivered to selector 38 by feed rollers 33 which then is set in the position indicated by two-dot chain line in FIG. 2. Thereupon, the sheet is delivered to exit rollers 34 and then discharged thereby into tray 35. Thus, the multiple copying operation is accomplished. Blue and/or green copies may further be superposed on the resultant copy by continuing the multiple copy mode.

In the arrangement described above, revolving unit 51, which is suspended so as to be rockable around support shaft 76, can easily be supported and moved relatively to photosensitive drum 22.

Even when motor 84 is deenergized and allowed to race, developing units 24 can be kept apart from or close to drum 22 due to the aforementioned positional relationship between first and second arms 85 and 87.

Moreover, toner hopper 104 on each developing unit 24 facilitates the resupply of toner T, permitting the use of even two-component developing agent G. Despite the simple construction, furthermore, the apparatus of the invention is highly reliable.

Figure 16:
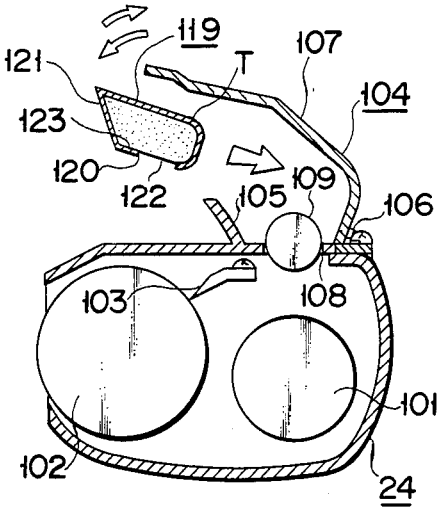
Figure 17:
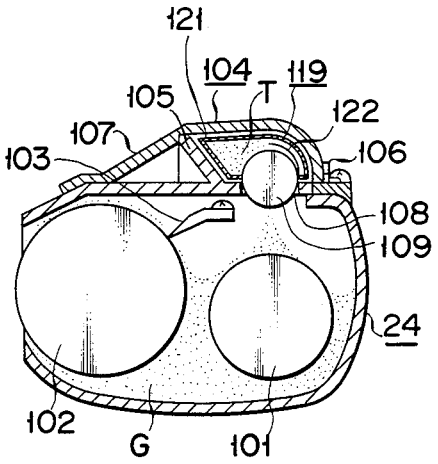

In the embodiment described above, toner T is put directly into toner hopper 104. Alternatively, however, hopper 104 may be loaded with toner cartridge 119, as shown in FIGS. 16 and 17. Cartridge 119 includes box-shaped toner vessel 121 having opening 120, lid 122 removably attached to opening 120 of vessel 121, and joint portion 123 closing the gap between vessel 121 and lid 122 to prevent toner T from spilling. Portion 123 is bonded to the periphery of opening 120 with a strength such that it is easily separated when lid 122 is pushed from the outside of vessel 121. After placing cartridge 119 on the top of resupply roller 109, with hopper cover 107 lifted, the operator swings down the cover shut. Thereupon, cartridge 119 is depressed by cover 107, so that lid 122 is pushed into vessel 121 to cause joint portion 123 to be separated. As a result, lid 122 and part of the peripheral wall of roller 109 are within vessel 121. Thus, cartridge 119 and roller 109 are ready for the toner supply to developing unit 24.

Figure 18:
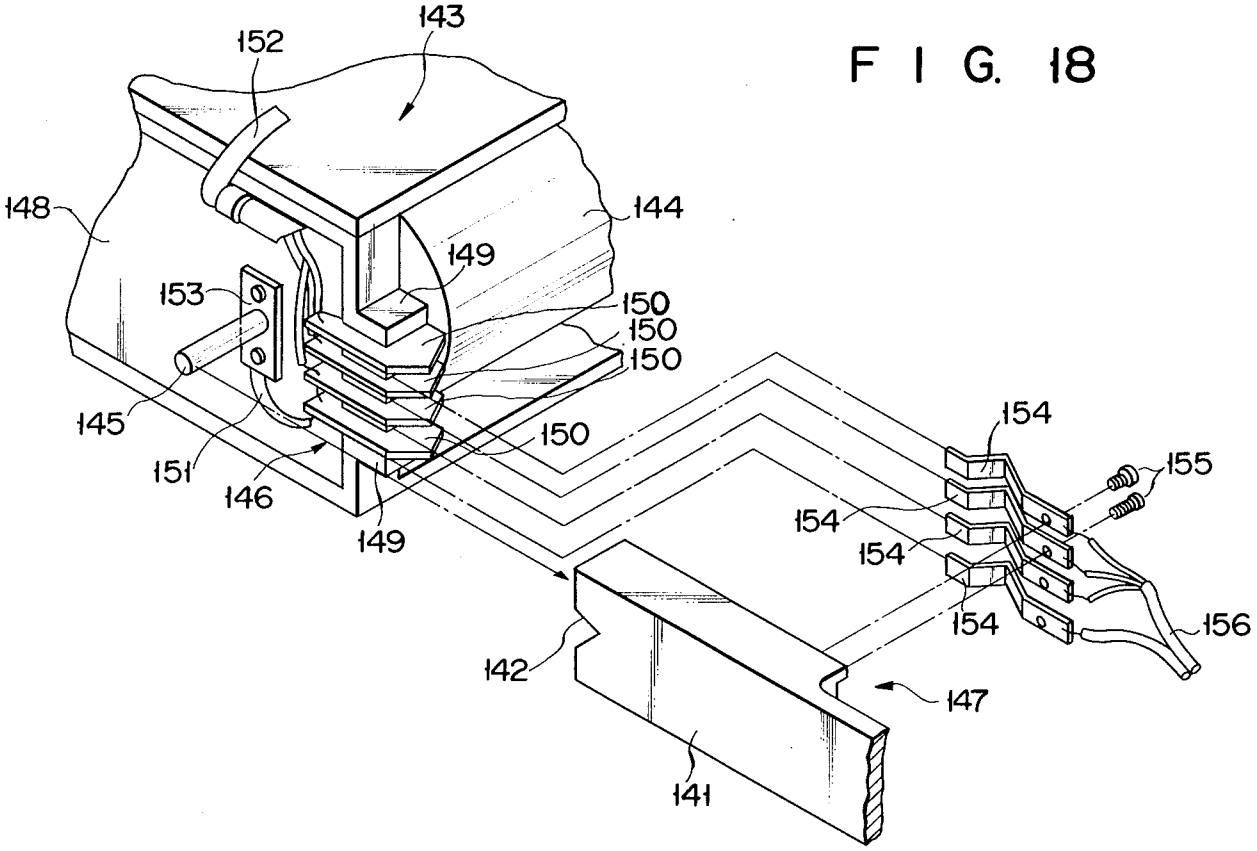
Figure 19:
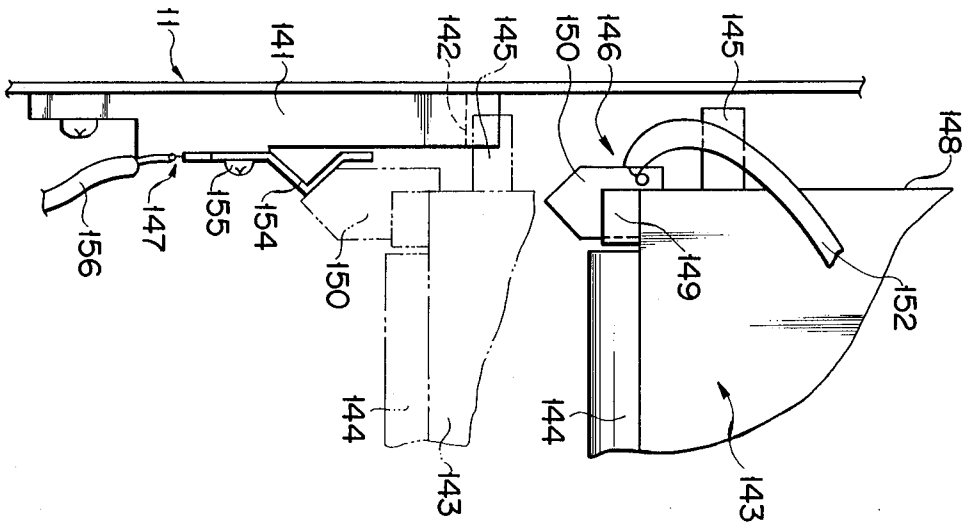

FIGS. 18 and 19 shows a modification of the means for relatively locating photosensitive drum 22 and the selected developing unit. Locating member 141 is fixedly attached to housing 11. V-shaped locating portion 142 is formed at the distal end of member 141. On the other hand, shaft 145 of developing roller 144 protrudes from the flank of developing unit 143 of this modification. When selected developing unit 143 approaches the developing region of photosensitive drum 22, roller shaft 145 engages locating portion 142 of member 141 to determine the relative positions of drum 22 and selected unit 143. This modified example is provided with connector means for electrically connecting unit 143 and housing 11. Specifically, receiving-end connector 146 is attached to the drum-side end portion of each developing unit 143, while sending-end connector 147 is provided on locating member 141. Connector 146 includes terminal mount 149 formed integrally on developing unit case 148 and a plurality of terminals 150 fixed on mount 149 in an electrically insulated manner and each having chevron-shaped contact portion. Terminals 150 are connected with wires 151 for developing bias voltage supply and wires 152 for toner density control signal transmission. Wires 151 are connected to metal fitting 153 for energizing the magnet of developing roller 144, while wires 152 are connected to a sensor (not shown) for controlling the specific toner density. Sending-end connector 147 includes a plurality of connecting terminals 154 fixed to locating member 141 in an electrically insulated manner by means of screws 155. Feeding wires 156 are connected to terminals 154.

When revolving unit 51 is moved toward photosensitive drum 22 by shifting mechanism 78 so that selected developing unit 143 is set in the developing region, terminals 150 of receiving-end connector 146 of unit 143 come into contact with connecting terminals 154 of sending-end connector 147, as indicated by the two dot line in FIG. 19. Thus, housing 11 and unit 143 are connected electrically. When revolving unit 51 is withdrawn from drum 22, terminals 150 of connector 146 are disengaged from terminals 154 of connector 147, so that housing 11 and developing unit 143 are disconnected.

In this embodiment, each terminal 154 of sending-end connector 147 is formed of a leaf spring having a dogleg portion which permits resilient contact of its corresponding terminal 150 of receiving-end connector 146. Alternatively, however, the situation between terminals 150 and 154 may be reversed.

Figure 20:
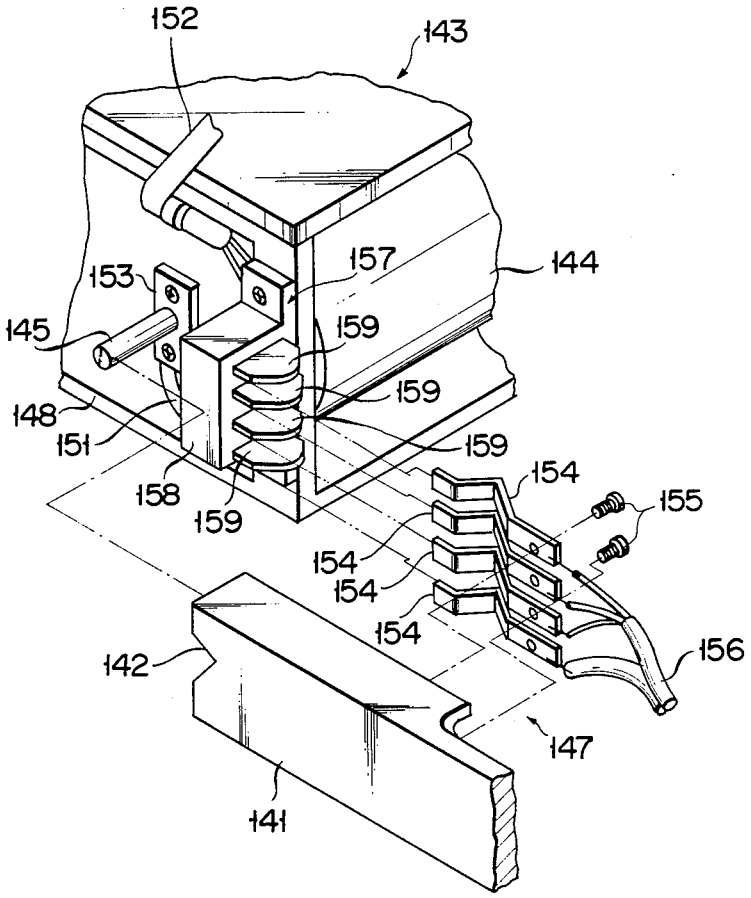
Figure 21:
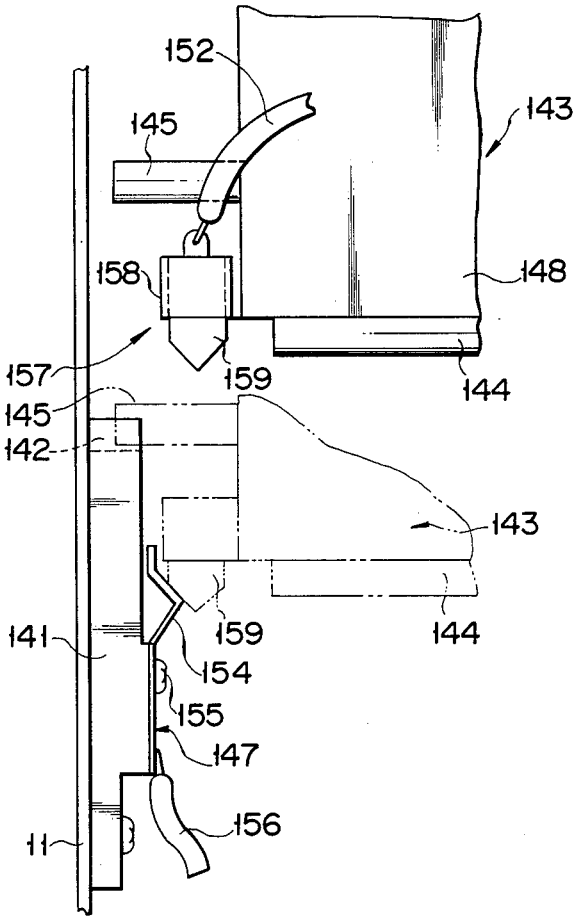
Figure 22:
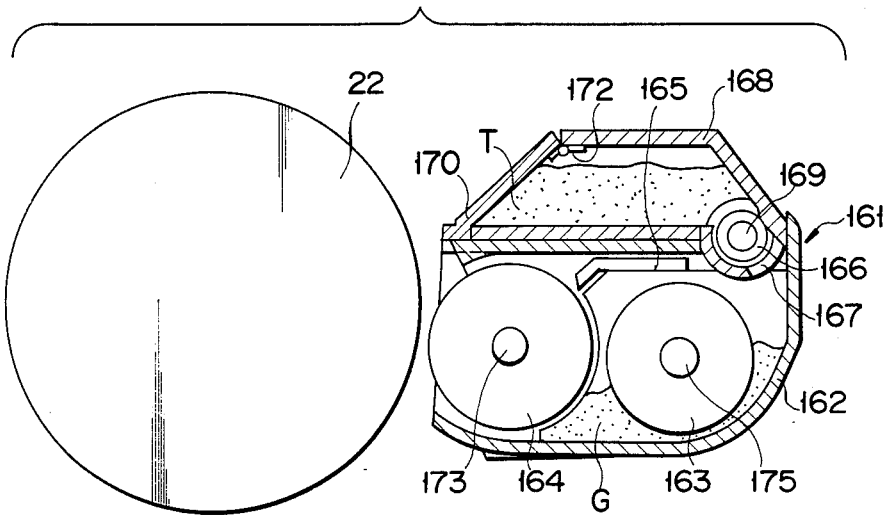

FIGS. 20 and 21 show a modification of the connector means. In this example, receiving-end connector 157 includes terminal box 158 fixed on an end face of developing unit case 148, and a plurality of terminals 159 fixed in box 158 in an electrically insulated manner and each having chevron-shaped contact portion projecting forward from an end face of box 158.

FIGS. 22 to 25 show a modification of the developing unit. In this example, developing unit 161 includes developing unit case 162 stored with developing agent G containing toner T and a carrier mixed at a suitable ratio, stirrer 163 for stirring agent G in case 162, developing roller 164 with a magnet therein for feeding stirred agent G onto photosensitive drum 22, and doctor blade 165 for regulating the thickness of a layer of agent G being advanced toward drum 22 by roller 164. Case 162 carries thereon flat toner hopper 168 which includes toner resupply roller 166 and toner resupply aperture 167. Hopper 168 can swing up and down around the axis of rotating shaft 169 of roller 166. Numeral 170 designates a lid which is mounted on hopper 168 by hinge means 172 so as to open and close toner inlet opening 171. Developing unit 161 is separated from drum 22 and hopper 168 is swung up when the hopper is to be replenished with toner T.

Figure 24:
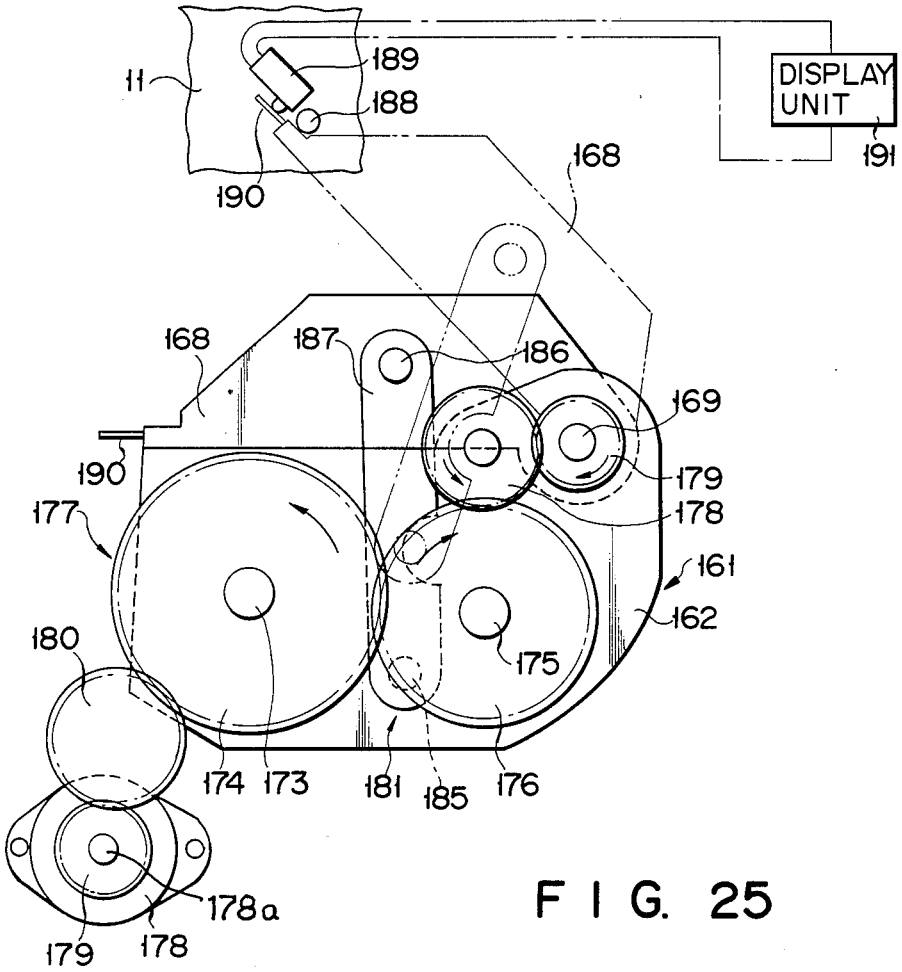

As shown in FIG. 24 developing roller gear 174 is mounted on shaft 173 of developing roller 164. It is in mesh with stirrer gear 176 which is mounted on shaft 175 of stirrer 163. Thus, gears 174 and 176 constitute rotation drive system 177 for developing unit 161. On the other hand, housing 11 is provided with driving gear 179 mounted on the shaft **178*a* of drive motor 178 and idle gear 180 in mesh with gear 179. When selected developing unit 161 of developing device 301 approaches photosensitive drum 22, gear 174 engages gear 180 as shown in FIG. 24, so that drive system 177 of selected developing unit 161 is rotated. The driving force is transmitted to resupply roller 166 through gears 176, 179, and 180** in succession.

Figure 23:
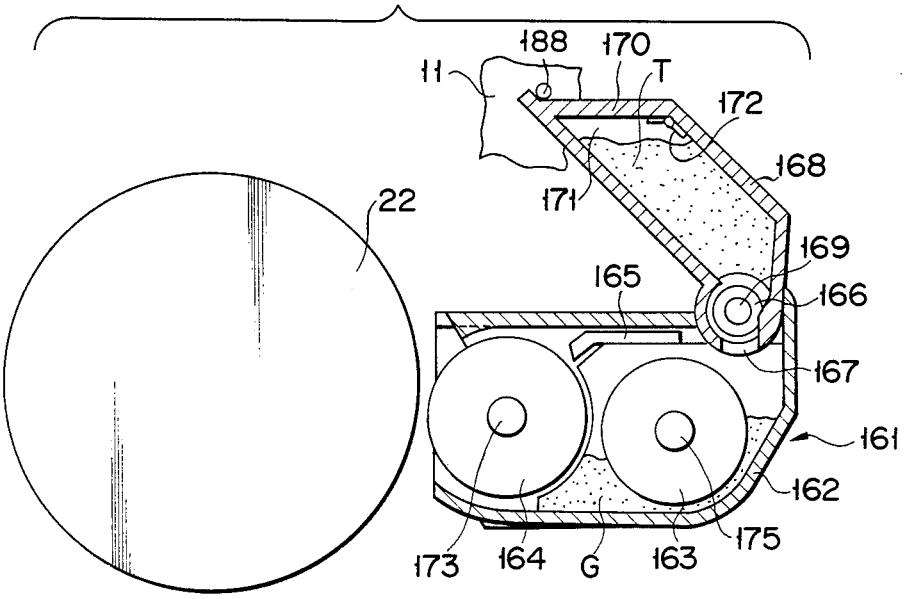
Figure 25:
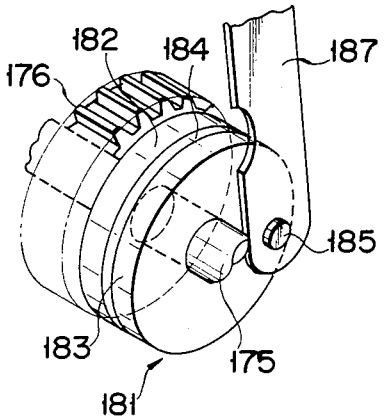

In FIGS. 24 and 25, numeral 181 denotes a hopper lifting mechanism of developing unit 161. Associated with drive system, 177, mechanism 181 serves to lift up toner hopper 168 as shown in FIG. 23 or indicated by the two dot line in FIG. 24. When system 177 rotates, mechanism 181 swings up hopper 168. When system 177 stops, mechanism 181 allows hopper 168 to fall by gravity. Even when system 177 is stopped, however, mechanism 181 prevents hopper 168 from falling, that is, keeps it lifted if the residual toner in the hopper is less than a predetermined quantity.

A specific construction of hopper lifting mechanism 181 will now be described in detail. Mechanism 181 includes first disk 182 formed integrally with stirrer gear 176 so as to be fixed relatively to stirrer shaft 175 as one of the rotating shafts in developing unit drive system 177, second disk 183 rotatably supported on shaft 175, and friction member 184 sandwiched between disks 182 and 183. Also, the lifting mechanism is provided with hopper lifting link 187 which is pivotally mounted, at its lower end portion, on pin 185 attached to disk 183 and, at its upper end portion, on pin 186 attached to hopper 168. Mechanism 181 further includes stopper 188 fixed to housing 11 so as to be located above toner hopper 168 of developing unit 161 set in the developing region. Stopper 188 is adapted to stop hopper 168 at an angle of elevation of, e.g., 45 degrees which is wider than the toner rest angle (at which hopper 168 causes toner T therein to start moving) when the hopper is lifted up, as shown in FIG. 23 or indicated by the two dot line in FIG. 24.

Frictional force between first disk 182, friction member 184, and second disk 183 is adjusted so that it surpasses the force needed to swing up hopper 168 full up with toner T while drive system 177 is rotating, and that it allows hopper 168 to swing down or fall by gravity if the quantity of toner T remaining in the hopper is not less than the predetermined residual quantity when system 177 is stopped. During the developing process, therefore, hopper 168 never fails to be lifted to an angle wider than the toner rest angle. When system 177 is stopped, moreover, hopper 168 swings down by gravity, restoring developing unit 161 to the state ready for the revolution. Even when system 177 is stopped, hopper 168 remains lifted if the toner in hopper 168 is less than the predetermined quantity.

In FIG. 24, numeral 189 denotes a sensor switch which is located at the hopper-lifting motion limit of developing unit 161 in its developing position, and is turned on and off by switch operating lever 190 attached to hopper 168. Numeral 191 designates a display unit which, electrically connected with switch 189, informs the user of a shortage of toner supply when hopper 168 remains lifted even though developing unit 161 is not engaged in developing. Unit 191 is disposed on a control panel (not shown) which is provided on the top of housing 11.

Figure 26:
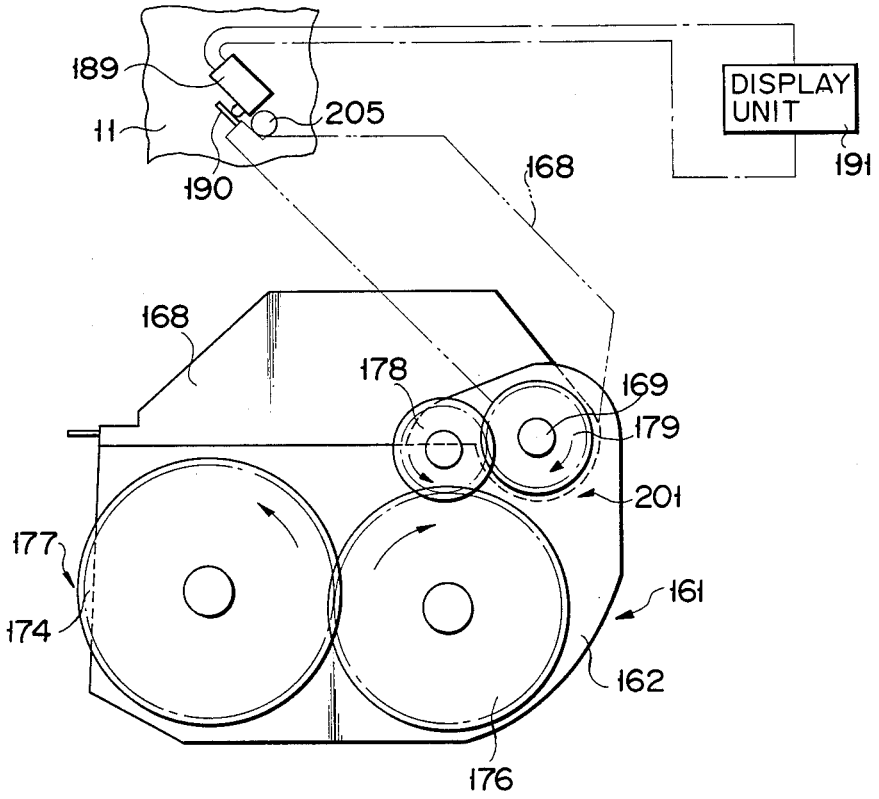
Figure 27:
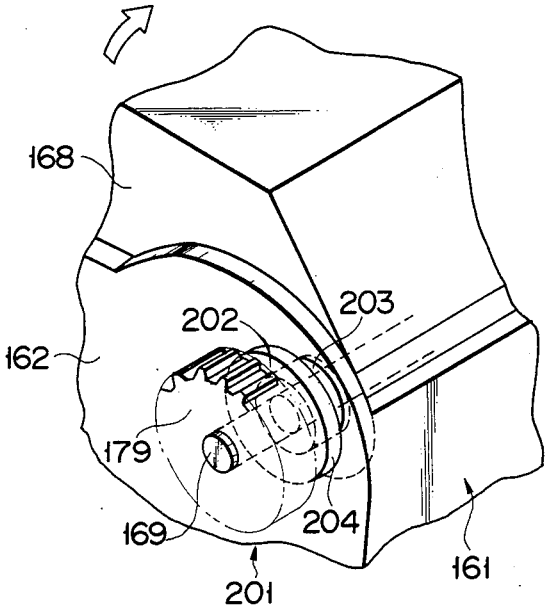
Figure 28:
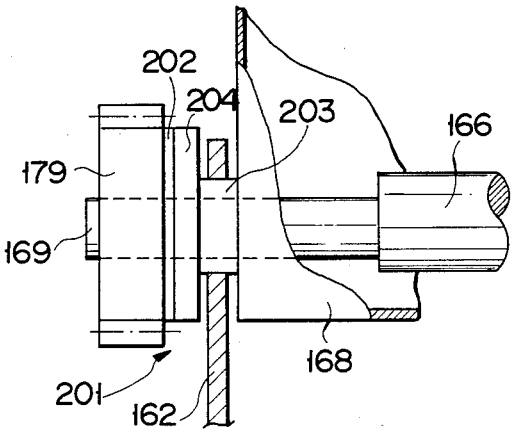

FIGS. 26 to 28 show a modification of the hopper lifting mechanism. In this example, lifting mechanism 201 includes first disk 202 formed integrally with resupply roller drive gear 179 so as to be fixed relatively to rotating shaft 169 of toner resupply roller 166 in developing unit drive system 177, second disk 203 rotatably fitted on shaft 169 and in developing unit case 162 and fixed to hopper 168 so as to rock as one therewith, and friction member 204 sandwiched between disks 202 and 203. Mechanism 201 further includes stopper 205 fixed to housing 11 so as to be located above toner hopper 168 of developing unit 161 set in the developing region. Stopper 205 is adapted to stop hopper 168 at an angle of elevation of, e.g., 45 degrees which is wider than the toner rest angle when the hopper is lifted up. As in the specific arrangement described before, frictional force between first disk 202, friction member 204, and second disk 203 is adjusted so that it surpasses the force needed to swing up hopper 168 full up with toner T while drive system 177 is rotating, and that it allows hopper 168 to swing down or fall by gravity if the quantity of toner T remaining in the hopper is not less than the predetermined residual quantity when system 177 is stopped.

In this modified example, when developing unit drive system 177 rotates, its rotation moment is transmitted from first disk 202 to second disk 203 via friction member 204. As disk 203 rocks, toner hopper 168 is lifted until it abuts against stopper 205. While hopper 168 is lifted, a slip is caused between friction member 204 and disks 202 and 203, permitting continued rotation of drive system 177. When system 177 stops, hopper 168 swings down by gravity if the quantity of toner T in the hopper is sufficient, restoring developing unit 161 to the state ready for the revolution. If the residual quantity of toner T in hopper 168 is insufficient, the hopper remains lifted. If sensor switch 189 detects the lifted position of hopper 168 and remains on, display unit 191 indicates a shortage of toner supply for the user's information.

FIGS. 29 to 34 show a modification of the developing device.

In this example, four developing units 211 each include developing unit case 212 stored with developing agent G containing toner T and a magnetic carrier mixed at a suitable ratio, stirrer 213 for stirring agent G in case 212, developing roller 214 with a magnet therein for feeding stirred agent G onto photosensitive drum 22, and doctor blade 215 for regulating the thickness of a layer of agent G being advanced toward drum 22 by roller 214. Top lid 216 of case 212 is formed with toner feed portion 218 having toner resupply aperture 217 which opens into case 212.

Developing roller gear 220 is mounted on shaft 219 of developing roller 214. It is in mesh with stirrer gear 222 which is mounted on shaft 221 of stirrer 213. On the other hand, housing 11 is provided with driving gear 224 mounted on the shaft **223*a* of drive motor 223 and idle gear 225 in mesh with gear 224. When selected developing unit 211 of developing device 301 approaches photosensitive drum 22, gear 220 engages gear 225 so that gears 220 and 222** are rotated.

Figure 29:
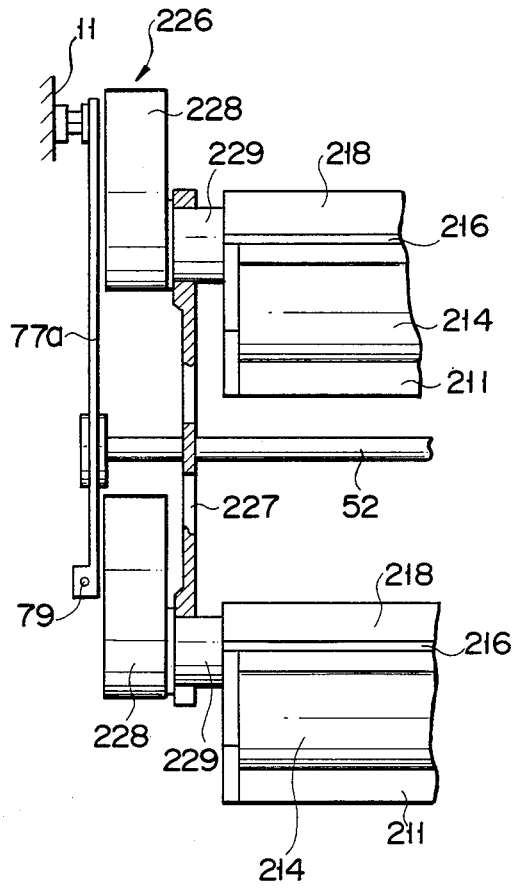
Figure 30:
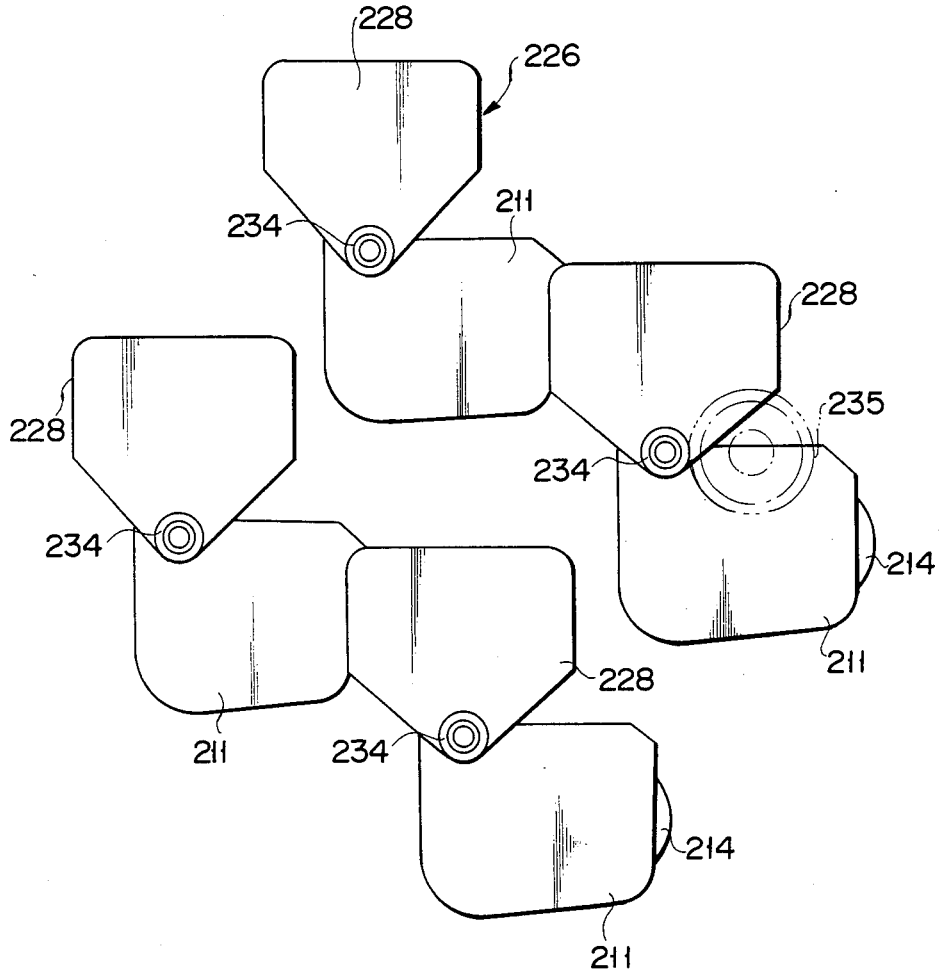
Figure 31:
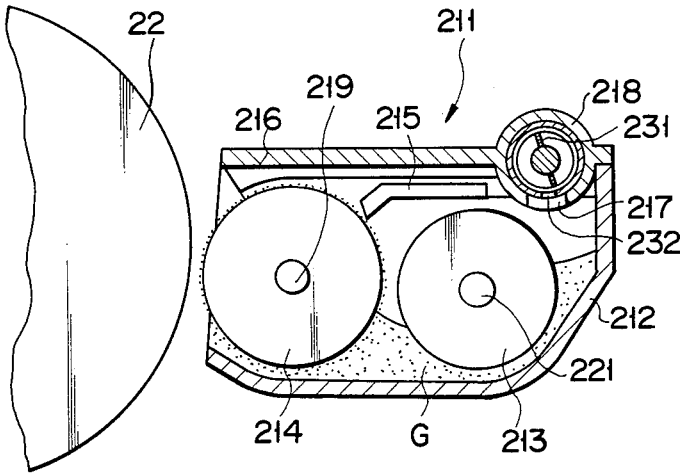
Figure 32:
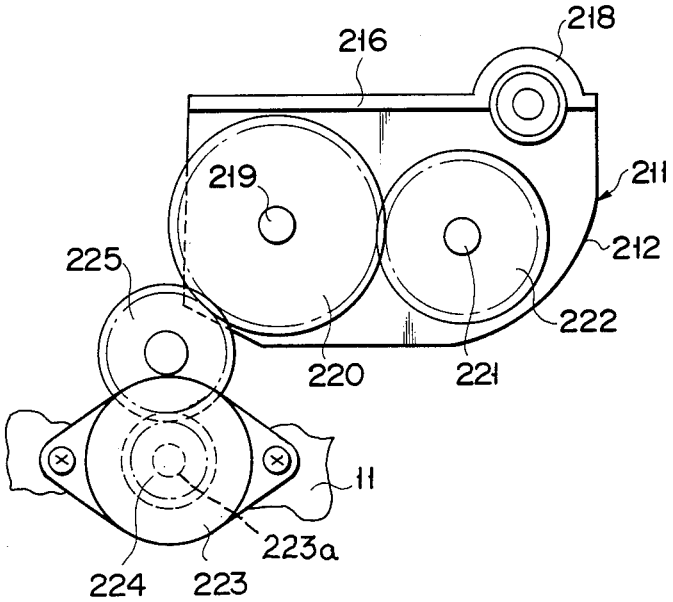
Figure 33:
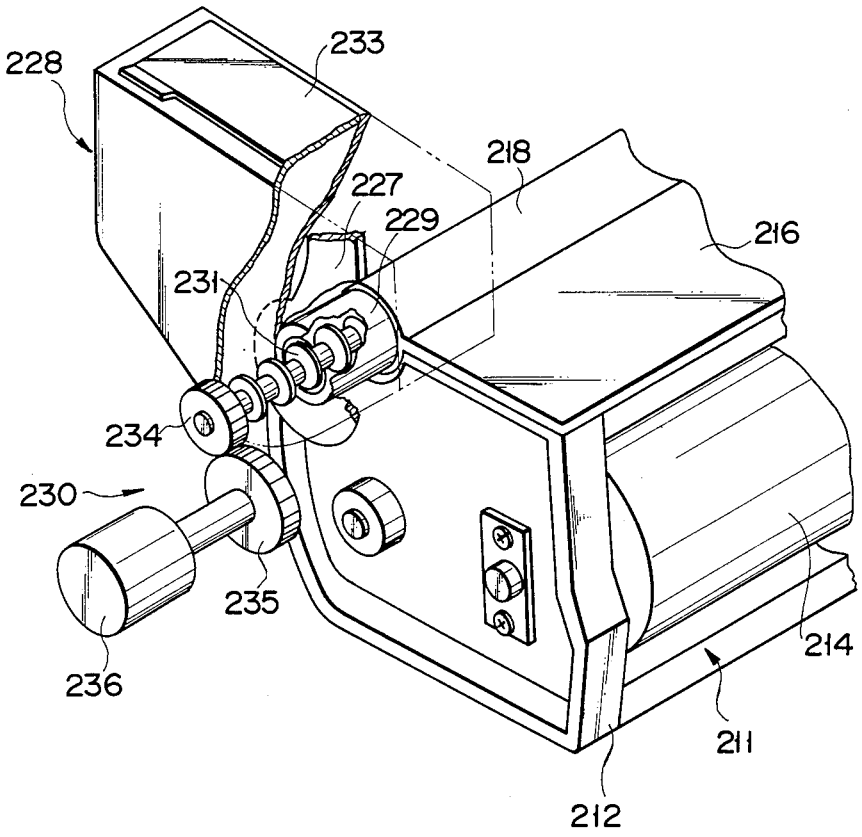
Figure 34:
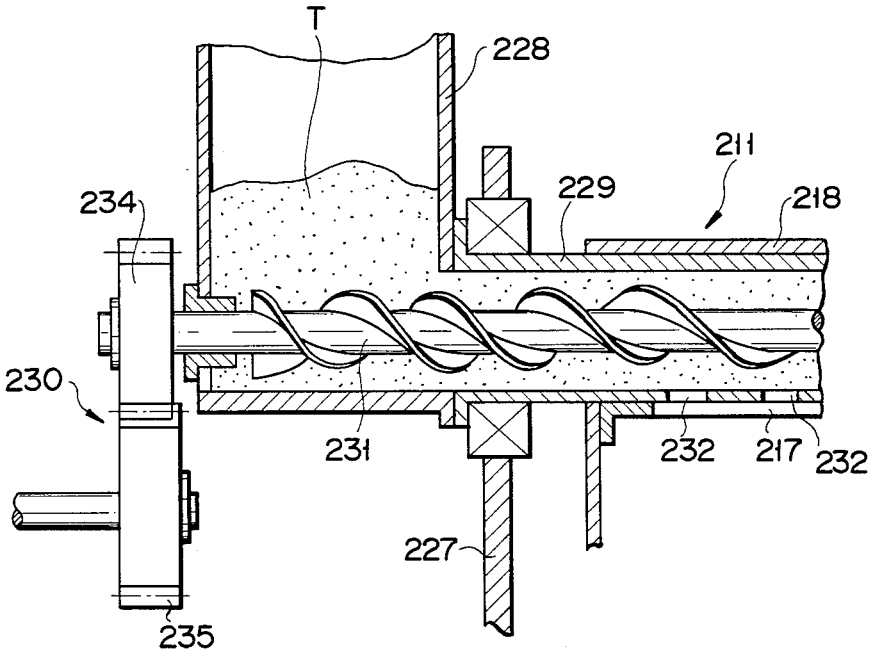

In FIGS. 29 and 30, numeral 226 designates a toner resupply unit, which includes a plurality of toner hoppers 228 arranged outside unilateral rotating frame 227 so as to correspond individually to developing units 211, and hollow coupling members 229 connecting hoppers 228 and developing units 211 for joint movement and supported, by frame 227. Unit 226 further includes screws 231 (see FIG. 31) inserted individually in members 229 and adapted to feed toner T from hoppers 228 into developing units 211 when rotated by drive means 230 (see FIG. 33).

Each coupling member 229 is a hollow pipe which is fitted in toner feed portion 218 of each corresponding developing unit 211, and has a plurality of toner resupply holes 232 arranged at intervals along the pipe axis and connecting with toner resupply aperture 217. The hopper-side end portion of member 229 pivotally supports rotating frame 227, constituting a left-side support mechanism for each developing unit 211. Each toner hopper 228 is a vertical square-shaped hopper with a large capacity. The top opening of the hopper is closed by removable hopper lid 233.

Drive means 230 for screw 231 includes screw rotating gear 234 mounted on a shaft end of screw 231 projecting outward from hopper 228, driving gear 235 on the side of housing 11, and motor 236 used to drive gear 235. Gear 235 is adapted to engage gear 234 to rotate screw 231 in an interlocked manner when selected developing unit 211 is set in the developing region.

When revolving unit 51 is moved toward photosensitive drum 22 by shifting mechanism 78 so that selected developing unit 211 is set in the developing region, developing roller gear 220 of unit 211 engages idle gear 225, and, at the same time, screw rotating gear 234 of unit 211 engages driving gear 224. If drive motors 223 and 236 are then actuated, therefore, developing roller 214 and stirrer 213 rotate, and screw 231 rotates so as to transport and feed toner T from hopper 228 into developing unit 211.

According to the arrangement described above, toner hoppers 228 can be arranged outside unilateral rotating frame 227 for the revolution of the developing units. Thus, the hopper capacity is increased. Since hollow coupling members 229 serve as shafts of their corresponding developing units 211, they cannot interfere with any other members during the revolution of units 211. Moreover, screw 231 of selected developing unit 211 can be driven directly from the outside of revolving unit 51, facilitating the control of the toner resupply operation.

Figure 35:
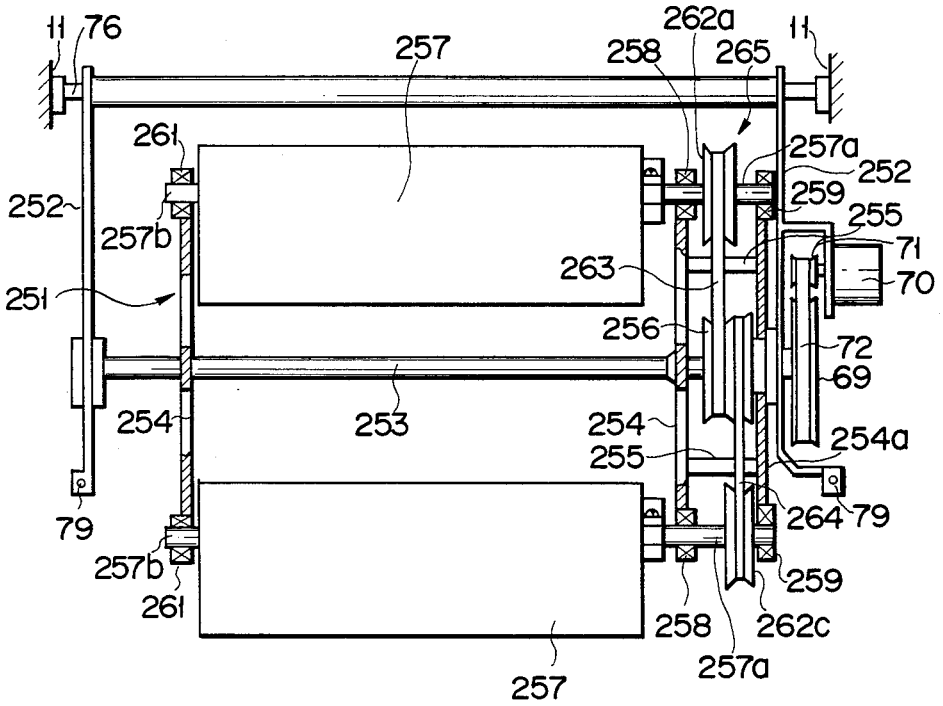
Figure 36:
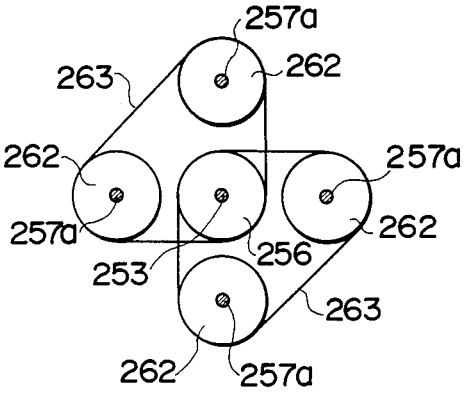

FIGS. 35 and 36 show a modification of the revolving unit.

In this modified example, revolving unit 251 includes shaft 253 supported between a pair of suspension members 252, a pair of rotating frames 254 fixed on shaft 253, and rotating subframe **254*a* separately facing one frame 254 (right-hand one as in FIG. 35) from the outside thereof. Subframe 254*a* is coupled to right-hand frame 254 for coaxial joint rotation by means of a plurality of stays 255. A center hole portion of the subframe is supported so as to rotate around a fixed boss portion of sun pulley 256 (mentioned later). Four developing units 257 are pivotally supported at both ends between rotating frames 254, extending parallel to shaft 253 and located on the circumference of a common circle around shaft 253. Right-hand support shaft 257*a* of each developing unit 257 is rotatably supported between frame 254 and subframe 254*a* by means of bearings 258 and 259. Left-hand support shaft 257*b* of unit 257 is rotatably supported on left-hand frame 254 by bearing 261**.

Planet pulley 262 is mounted on that portion of right-hand shaft **257*a* of each developing unit 257 between frames 254 and 254*a*. One timing belt 263 is passed around two out of the four planet pulleys and sun pulley 256 which is fixed on right-hand suspension member 252 and loosely fitted on shaft 253 for rotation. The other timing belt 263 is passed around the other two planet pulleys and sun pulley 256. These pulleys and belts constitute horizontal retaining mechanism 265 for developing units 257**.

According to the arrangement described above, the apparatus can be made simpler in construction than the apparatus which is provided with horizontal retaining mechanisms for the developing units on either side thereof. Despite the use of unilateral retaining mechanism 265, moreover, the support structure is strongly-built, since right-hand support shaft **257*a* of each developing unit 257 is supported between frames 254 and 254*a*** on the right-hand side. Thus, during the revolution of the developing units, the rotation moment can smoothly be transmitted without a twist in the structure.

In the embodiment described above, the apparatus of the present invention is applied to a copying machine capable of multicolor copying operation. The invention is not, however, limited to that embodiment, and may also be applied to a copying machine in which a paper sheet is circulated for both-sided copying.

Although the apparatus of the invention is applied to a copying machine in the above embodiment, moreover, the invention may also be applied electronic printers, facsimiles, printing machines and various other image forming apparatuses.

What is claimed is:

1. An image forming apparatus comprising:

(a) an image carrier adapted to carry a latent image thereon;

(b) a plurality of developing units for developing a latent image on the image carrier, said developing units adapted to contain developing agents of different colors;

(c) revolving means for revolving the developing units in parallel relation and selecting one of the developing units for use by stopping the revolving of the developing units at a predetermined position;

(d) support means, having a center of rocking, for supporting the revolving means at a distance from the center;

(e) shifting means for moving the revolving means supported by the support means toward or away from the image carrier; and (f) locating means for determining the relative positions of the image carrier and the developing unit selected by the revolving means when the revolving means approaches the image carrier.

2. The image forming apparatus according to claim 1, wherein said shifting means includes:

(a) resilient means for urging the support means in a direction such that the revolving means approaches the image carrier, and (b) release means for releasing the urging action of the resilient means.

3. The image forming apparatus according to claim 2, wherein said release means includes:

(a) a motor, (b) a first arm rotated by the motor, and (c) a second arm rocked by the rotation of the first arm to actuate the support means in a linked manner, (d) said first and second arms being adapted to meet at right angles when the revolving means is separated from the image carrier, so that the urging action of the resilient means is kept ineffective even though the motor is deenergized.

4. The image forming apparatus according to claim 1, wherein each said developing unit includes replenishing means for resupplying the developing agent.

5. The image forming apparatus according to claim 4, wherein said replenishing means is provided in the top portion of the developing unit.

6. The image forming apparatus according to claim 4, wherein said replenishing means has a cartridge stored with the developing agent, which may be removable against the replenishing means.

7. The image forming apparatus according to claim 4, wherein said replenishing means is attached to each developing unit such that the developing units do not interfere with one another while revolving.

* * * * *